US006758869B2

(12) United States Patent
Roeske et al.

(10) Patent No.: US 6,758,869 B2
(45) Date of Patent: Jul. 6, 2004

(54) NON SOOTING PARAFFIN CONTAINING CANDLE

(75) Inventors: Alfred D. Roeske, Veneta, OR (US); Jerome C. Bertrand, Menlo Park, CA (US)

(73) Assignee: Cleanwax, LLP, Eugene, OR (US)

( * ) Notice: Subject to any disclaimer, the term of this patent is extended or adjusted under 35 U.S.C. 154(b) by 0 days.

(21) Appl. No.: 09/755,644

(22) Filed: Jan. 6, 2001

(65) Prior Publication Data

US 2002/0005007 A1 Jan. 17, 2002

Related U.S. Application Data

(60) Provisional application No. 60/179,767, filed on Feb. 2, 2000.

(51) Int. Cl.[7] ..... C11C 5/00
(52) U.S. Cl. ..... 44/275; 431/288
(58) Field of Search ..... 44/275; 431/288

(56) References Cited

U.S. PATENT DOCUMENTS

| | | | | | |
|---|---|---|---|---|---|
| 26,780 | A | * | 1/1860 | Moefit | 44/275 |
| 400,651 | A | * | 4/1889 | Fealy | 44/275 |
| 809,121 | A | * | 1/1906 | Lewy | 44/275 |
| 1,229,132 | A | | 6/1917 | Philip | |
| 1,935,946 | A | * | 11/1933 | Egan | 44/275 |
| 1,954,659 | A | * | 4/1934 | Will | 44/275 |
| 1,958,462 | A | * | 5/1934 | Baumer | 44/275 |
| 2,159,218 | A | * | 5/1939 | MacLaren | 44/275 |
| 3,615,284 | A | | 10/1971 | Cassar | 44/1 R |
| 3,615,289 | A | | 10/1971 | Felton | 44/7.5 |
| 3,630,695 | A | | 12/1971 | Dulling et al. | 44/1 R |
| 3,630,697 | A | | 12/1971 | Dulling et al. | 44/7.5 |
| 3,645,705 | A | | 2/1972 | Miller et al. | 44/7.5 |
| 3,819,342 | A | | 6/1974 | Gunderman et al. | 44/7.5 |
| 3,844,706 | A | | 10/1974 | Tsaras | 431/288 |
| 3,871,815 | A | | 3/1975 | Cangardel | 431/126 |
| 4,049,893 | A | | 9/1977 | Kldwell, Jr. | 526/26 |
| 4,507,077 | A | | 3/1985 | Sapper | 431/228 |
| 4,714,496 | A | | 12/1987 | Luken, Jr. et al. | 106/270 |
| 4,759,709 | A | | 7/1988 | Luken, Jr. et al. | 431/288 |
| 4,790,747 | A | | 12/1988 | O'Brien | 431/325 |
| 4,813,975 | A | | 3/1989 | Poulina et al. | 44/7.5 |
| 4,842,648 | A | | 6/1989 | Phadoemchit et al. | 106/244 |
| 5,578,089 | A | | 11/1996 | Elsamaloty | 44/275 |
| 5,753,015 | A | * | 5/1998 | Sinwald et al. | 106/31.34 |
| 5,882,363 | A | | 3/1999 | Spaulding et al. | 44/275 |
| 6,054,517 | A | | 4/2000 | Spaulding et al. | 524/275 |
| 6,063,144 | A | | 5/2000 | Calzada et al. | 44/275 |
| 6,214,918 | B1 | * | 4/2001 | Johnson | 524/487 |
| 6,224,641 | B1 | * | 5/2001 | Matzat | 44/275 |
| 6,284,007 | B1 | | 9/2001 | Tao | 44/275 |

FOREIGN PATENT DOCUMENTS

| | | |
|---|---|---|
| CH | 646717 | 12/1984 |
| EP | 407913 A2 | 1/1991 |
| JP | 404059897 A | 2/1992 |

OTHER PUBLICATIONS www.tl–food.com/english/indexl_eng.htm.*

* cited by examiner

*Primary Examiner*—Cephia D. Toomer
(74) *Attorney, Agent, or Firm*—Medlen & Carroll LLP

(57) ABSTRACT

Substantially soot free candles that incorporate paraffin and fatty material (hydrogenated triglycerides (TG) and/or free fatty acids (FFA)) that has a low Iodine Value (IV). The use of low IV fatty material and proper component percentages results in low soot or soot free candles. Paraffin/TG, paraffin/TG/FFA and paraffin/FFA candles are disclosed as are appropriate component percentages and/or IV values to achieve desired low or non sooting characteristics.

24 Claims, 1 Drawing Sheet

NON SOOTING PARAFFIN CONTAINING CANDLE

CROSS REFERENCE TO RELATED APPLICATIONS

This application claims the benefit of U.S. Provisional Application No. 60/179,767, filed Feb. 2, 2000, and having the same title and inventor(s) as above.

This application is related to U.S. patent application Ser. No. 09/670,181, filed Sep. 25, 2000, by Alfred D. Roeske and entitled Low-Soot, Low-Smoke Renewable Resource Candle, which is hereby incorporated by reference.

FIELD OF THE INVENTION

The present invention relates to low-soot and/or non-soot candles that contain paraffin wax.

BACKGROUND OF THE INVENTION

Paraffin wax is a product of petroleum distillation and is widely used in the production of candles. Paraffin is produced with slightly varying compositions depending on its intended use. Representative paraffin may contain normal paraffins, iso paraffins, cycloalkanes, aromatic compounds including substituted benzenes, substituted toluenes, substituted xylenes, polynuclear aromatics (like phenanthrene, anthracene, etc.), and alkylaromatic compounds of many kinds. Paraffin is used in candles because of its relative abundance, ease of processing, and favorable economics.

In modern candle making, paraffin wax is typically mixed with stearic acid. Varying the percent of paraffin to stearic acid tends to vary candle characteristics such as melting point, crystal structure, opacity, etc. Many of the candles currently sold are paraffin-stearic acid candles with paraffin contents of approximately 85–95% by weight.

A drawback of paraffin candles, however, is that they readily produce soot. Soot, which is largely synonymous with "smoke," is made up of incomplete combustion products. In contrast, complete combustion produces only $CO_2$ and $H_2O$ (carbon and hydrogen in their fully oxygenated states). For paraffin containing candles the incomplete combustion products may include polynuclear aromatic materials (such as naphthalene, phenanthrene, anthracene, etc.) and long-chain and/or crossed-linked carbon molecules and polymers thereof. These products may resemble black floating material as they rise from a flame. Soot may be distinguished from usually lighter colored vapor which comprises non-combusted paraffin wax and fragrance chemicals/components. When a candle is extinguished these compounds may be visible as vaporized material that is now condensing. This condensing material is not related to soot.

Soot is not desired because it may contribute to health problems, particularly respiratory ailments and sensitive eye conditions. Soot is also disfavored because it discolors walls, curtains and candle holders, etc., and is otherwise unsightly.

Notwithstanding this disadvantageous aspect of paraffin, paraffin is widely used in the candle industry. Instead of finding a complete alternative to paraffin that is low soot or soot free, it would be highly desirable to be able to produce a candle that contains paraffin (due to its wide acceptance, low-cost and familiarity in the industry), yet does not produce soot or is substantially non-sooting.

As discussed in more detail below, the present invention achieves a non-soot or low-soot paraffin containing candle by combining hydrogenated triglycerides (TGs) and/or free fatty acids (FFAs) with paraffin. The present invention, however, is not the first to combine TGs or FFAs and paraffin (though it is the first to process and combine them in such a manner as to achieve a substantially non-sooting candle). Prior art TG considerations are discussed first, followed by prior art FFA considerations.

U.S. Pat. No. 1,954,659, issued to Will on Aug. 6, 1934, for a Candle and Method of Making Same, teaches a candle that includes "50% or more vegetable oil combined with paraffin wax, stearic acid, beeswax or other waxes, . . . if the vegetable oil, such as rapeseed oil is first hydrogenated." The goal of the Will patent is to process vegetable oil in such a manner as to cause it to change from a liquid to a solid. The type of oil used by Will (e.g., high erucic-content rapeseed) combined with his "hydrogenation" method achieved a solidification or "hardening" of the oil. Nonetheless, Will's use of the word "hydrogenation" has a meaning different from hydrogenation as used in the present invention.

Circa 1930, hydrogenation was carried out using a hydrogenation catalyst that favored both (1) hydrogenation of unsaturated triglyceride fatty acid molecules and (2) isomerization of cis ("Z") fatty acid isomers to trans ("E") fatty acid isomers. Both (1) and (2) result in an increased melting point, and thus the desired "hardening" of the oil is achieved without fully hydrogenating the unsaturated triglycerides. This in turn results in a candle that is sufficiently hard for its intended purpose (to be freestanding), but that creates an undesirable amount of soot or smoke due to unsaturated triglycerides.

By circa 1930 standards, it is estimated that the Iodine Value (IV, a measure of the degree of unsaturation of a fatty acid, defined below) for hydrogenated rapeseed oil would have been 15 or greater because of isomerization and high erucic acid content (approximately 20% or higher C22 mono-unsaturated fatty acid content) Thus, a paraffin and TG candle made by Will would have produced significant amounts of soot due to both paraffin and unsaturated TG combustion products.

In contrast to TGs which appear to have not been used in candles for the last 70 years, FFAs have been used (combined with paraffin) regularly from the time of Will to the present. Typically, paraffin/FFA candles are approximately 85–95% paraffin and 5–15% FFA, by weight (amongst other ingredients). The FFA is added to enhance the opacity of the resultant candle. Since hydrogenation techniques have improved since the time of Will, it is now possible to produce stearic acid (a common FFA) that has an IV near 1 and below.

Current paraffin/FFA candles that include this low IV FFA material still produce undesired amounts of soot, however, because the limited amount of low IV FFA in the candle mixture is not sufficient to compensate for the soot (i.e., the combustion products) of the remaining paraffin. This is in part due to the fact that in prior art paraffin/FFA candles, the FFA was not added to reduce soot, but to effect opacity and/or rheology. Thus, a need does exist for a paraffin/FFA candle that is substantially non-sooting.

It should also be recognized that paraffin is derived from a non-renewable source. Therefore, to the extent the present invention uses material other than paraffin in a candle, there is a need to utilize material from a renewable source.

SUMMARY OF THE INVENTION

Accordingly, it is an object of the present invention to provide a substantially soot free candle that contains paraffin.

It is another object of the present invention to provide a substantially soot free paraffin containing candle that includes low IV triglycerides.

It is also an object of the present invention to provide a substantially soot free paraffin containing candle that includes low IV free fatty acids.

These and related objects of the present invention are achieved by the substantially non sooting paraffin containing candles as described herein.

The present invention includes at least three groups of candles. Those are paraffin/TG/FFA, paraffin/TG and paraffin/FFA candles. The paraffin/TG/FFA and paraffin/TG candles preferably contain fatty material having an IV of approximately 12.5 or less (thus including IVs of 8, 5, 3, 1, 0.5, etc.).

The paraffin/FFA candles preferably contain greater than approximately 15% FFA by weight (e.g., 20%, 30%, 40%, 50%, 60%, etc.) and the IV of that FFA is preferably approximately 2 or less.

The fatty material (TG or FFA) is preferably plant source, but may be from other sources.

The amount of paraffin in a candle of the present invention may vary widely, depending on TG and/or FFA percentages and IV values, amongst other considerations.

The attainment of the foregoing and related advantages and features of the invention should be more readily apparent to those skilled in the art, after review of the following more detailed description of the invention taken together with the drawings.

DETAILED DESCRIPTION

Figure 1:
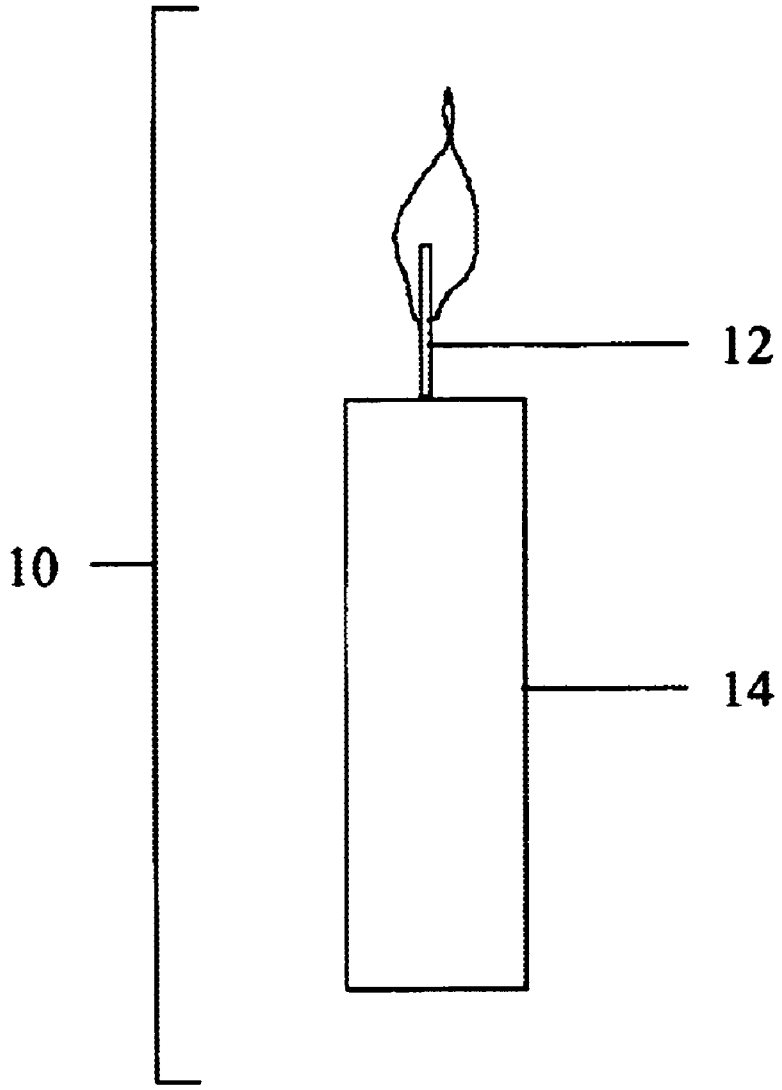
FIG. 1 is a diagram of a candle in accordance with the present invention.

The present invention achieves reduced soot candles by virtue in part of using fatty material (a term that includes triglycerides and free fatty acids) that has low Iodine Values (IVs). IV for purposes of the present invention is a measure of the unsaturation of fats and oils and is expressed in terms of the number of centigrams of iodine absorbed per gram of sample (% iodine absorbed). The preferred measurement protocol is Official Method Cd 1d-92 of the American Oil Chemists Society, though other protocols may be used. IVs are an indication of the degree of unsaturation within the triglycerides and/or free fatty acids, and the amount of unsaturated triglycerides and/or fatty acids is proportional to the amount of undesired combustion products (i.e., soot and smoke, etc.). Thus, reducing the level of unsaturation in the TG and/or FFA components of the candle significantly reduces soot production. As discussed below, the amount of soot reduction exhibited by candle blends in accordance with the present invention is beyond that which would have been expected based merely on lowered unsaturation levels, thus suggesting possible catalytic interaction between the low IV TGs and/or FFAs and the paraffin material.

The present invention includes candles comprised of triglyceride materials (alone or in combination with free fatty acids) that have IVs below 15 and, for example, include candles with collective TG and FFA IVs of less than 12.5, 10, 8, 5, 3 and 1, etc. In a more preferred embodiment of a TG/FFA/paraffin candle in accordance with the present invention, the IV of the triglyceride and fatty acid components are collectively less than one indicating substantially complete saturation. The present invention also includes a paraffin/FFA candle. The paraffin/FFA candles preferably have low IVs and FFA concentrations above 15% by weight (as discussed in more detail below).

In the text that follows, various component combinations are disclosed that are directed towards creating an inexpensive, clean burning candle. Due to more recent improvements in hydrogenation techniques, it is possible to produce TG and FFA materials that have sufficiently low IVs such that substantially non sooting candles can be produced. Various component concentrations and IVs for these components are discussed below. Certain hydrogenation considerations are also discussed below.

Referring to FIG. 1, a diagram of a candle 10 in accordance with the present invention is shown. Candle 10 includes a wick 12 that is provided within candle material 14. The wick is preferably made of cotton or cotton with a paper core or any other suitable wick substance. The candle material preferably includes paraffin and low IV triglycerides (TGs) and/or free fatty acids (FFAs) as discussed in more detail below.

Experiments were conducted in accordance with the present invention in which paraffin was combined with low IV TGs and/or FFAs to determine the amount of soot produced by the resultant combination candles.

Prior to these experiments, we speculated that the amount of soot reduction, if any, would occur in a linear or pro rata manner. For example, if a 100% paraffin candle produces X amount of soot, then candles that are 50% paraffin and 50% non-sooting material might be expected to produce an amount of soot equal to X/2. The results of our experiments, however, were not consistent with this expectation. The amount of soot reduction was significantly greater.

In an initial experiment, candles were made that combined paraffin with plant source triglycerides (TGs) and plant source free fatty acids (FFAs). The TG and FFA material was preprocessed to have low IVs (for example, in a first experiment the collective IV was $\leqq 1$). The percentage by weight of each component was approximately 50, 45 and 5 percent (paraffin, TG and FFA, respectively). These candles produced no detectable soot.

In another experiment, the amount of FFA was significantly reduced or eliminated, thus producing candles that were nearly 50% paraffin and 50% TG (with approximately 0.5% or less FFA). These candles also produced no detectable soot. In yet another experiment, the amount of TG was significantly reduced or eliminated, producing candles that were primarily comprised of paraffin and low IV FFA. Increasing the concentration of low IV FFA (in addition to decreasing the IV of the FFA), decreased soot production. This and like experiments are discussed below at Table III.

Varying Fatty Material IV—TG Containing Candle

Additional experiments were conducted to examine the effects of varying the IV of fatty material in paraffin candles that include TG and FFA material. Table I illustrates a group of candles within the present invention which the IV of the fatty material is successively reduced.

TABLE I

| Varied IV Fatty Material | | | |
|---|---|---|---|
| No. | Paraffin | TG/FFA | Coll IV |
| 1 | 50 | 45/5 | ~14 |
| 2 | 50 | 45/5 | ~12.5 |
| 3 | 50 | 45/5 | ~10 |

TABLE I-continued

| Varied IV Fatty Material | | | |
|---|---|---|---|
| No. | Paraffin | TG/FFA | Coll IV |
| 4 | 50 | 45/5 | ~8 |
| 5 | 50 | 45/5 | ~5 |
| 6 | 50 | 45/5 | ~3 |
| 7 | 50 | 45/5 | ~1 |
| 8 | 50 | 45/5 | ~0.5 |

The first column is the candle mix number, the second column is the approximate paraffin percentage by weight, the third column is the approximate TG and FFA percentages by weight and the fourth column is the collective IV of the fatty material (i.e., the TGs and FFAs). Note that in these experiments/embodiments and in other herein, the component percentages are approximate and trace amounts of other substances may be present, including but not limited to, related fatty compounds and fragrance and color compounds.

Candles with IVs of approximately 10–14 displayed generally improved non-sooting properties compared to conventional candles. Candles with IVs below 10 displayed further improved non-sooting characteristics and tended (particularly those with IVs of 5–3 or below) to produce no measurable soot.

While candles having a 9:1 ratio of TG to FFA are shown in Table I, it should be recognized that the percentage of FFA in the fatty material may range from 0% to more than 50% without deviating from the present invention.

Two different tests were performed to determine the level of sooting for candles. The first test was the "laminar smoke height test" which is a scientific measure of an organic material's propensity to produce soot during combustion. This test is a standard in studies of diffusion flames (a proper characterization of candle flames) and is widely accepted within the combustion research community. The second test was the white linen "handkerchief burn test" which is a filtration test technique that lacks scientific rigor but can be used as a screening method to indicate a candle's likelihood of producing soot under actual use conditions.

Laminar Smoke Height Test

In the laminar smoke height test, the laminar smoke point is the luminosity length of a flame at the onset of soot emissions. Smoke heights (also called smoke points) are the critical flame length such that longer flames emit smoke and shorter flames do not. Soot emissions were detected visually as black smoke and sooting conditions were observed to be associated with flames whose "ears" extended beyond the centerline height of the flame. (This is consistent with published observations (e.g. Schug et al., 1980)). The "ears" of the flame are the developing upward projections occurring at the outer edges of the flame as the soot formation begins to exceed the soot consumption within the flame boundaries and smoking (the emitting of soot) is about to begin.

Wick Selection and Preparation

Wicks used for the laminar smoke height test were #3 round wicks, approximately 3 mm in diameter. The individual wicks were cut to length and primed with wax melted from the intended candle.

Enclosure

These tests were conducted within a windowed rectangular enclosure to minimize flickering and disturbances from drafts. The enclosure was nearly cubical with sides of length 30 cm. Fresh air was frequently introduced into the enclosure to minimize oxygen vitiation.

Wick and Candle Installation

The wax-stiffened wick was inserted into the candle. When necessary the candle was reamed with a drill bit to better accommodate the wick. A vertical ruler was aligned with the base of the flame.

Smoke Height Measurement

The wick was adjusted to ¼" extension and ignited. Smoke heights were found by examining the flame tip near the axis as the wick height and, consequently, the flame height were increased.

For narrow wicks, the onset of soot emissions was observed to coincide with conditions where the flame ears were equal in height to the flame centerline. For broad wicks, the onset of soot emissions was observed to coincide with the transition from a sharply defined flame tip to one above which appeared an orange haze, attributed to quenched soot. These observations of incipiently sooting conditions are consistent with the published observations (e.g. Schug et al., 1980) and were verified periodically using a DustTrak aerosol monitor manufactured by TSI Incorporated.

White Linen Handkerchief Burn Test

The handkerchief burn test is a filtration procedure used as an indicator of soot formation. It is conducted using a white cotton handkerchief as a filtration medium to collect soot formed by a burning candle. The portions of the handkerchief surface suspended above the candle flame are compared to a clean un-used handkerchief. The whiter the handkerchief the less the soot formation. While the estimation of collected soot to total produced soot ratio is probably 20% or lower this method can be used to screen for sooting candle compositions and constructions.

Test Materials

Properly wicked candles were used in this test. The filtration medium was a 100% cotton handkerchief (Strafford brand available at JC Penney stores). Timing mechanisms were preferably utilized to record total elapsed burn time. A burning chamber was constructed as follows: a wooden or corrugated cardboard chimney was constructed having the dimensions of 10½" wide by 7" deep by 18" high with the sides of the rectangular solid touching the surface while the front had an opening created by cutting out the first 5½" of the panel at the bottom and the back had an opening created by cutting out the first 1½" of the panel at the bottom. The openings allowed for convective ventilation necessary to cause any soot formed in the candle flame to rise and collect on the handkerchief surface.

Test Procedure

The handkerchief was placed on top of the burning chamber. The candle was ignited and placed in the center of the chamber below the handkerchief. The candle was burned until all of the material was consumed (time was recorded to determine the total burn time). The "burn" handkerchief was visually compared to a clean (untested) white linen handkerchief. The desired results suggesting non-sooting were no visible signs of soot on the handkerchief.

Other Experiments/Embodiments

Table II illustrates further embodiments of the present invention with varied paraffin, TG and FFA percentages in addition to varied IVs.

TABLE II

Varied Percentages and Varied IVs

| No. | Paraffin | TG/FFA | TR1 | TR2 | TR3 | TR4 |
|---|---|---|---|---|---|---|
| 1 | 90 | 9/1 | ≦10 | ≦5 | ≦3 | ≦1 |
| 2 | 80 | 18/2 | ≦10 | ≦5 | ≦3 | ≦1 |
| 3 | 70 | 27/3 | ≦10 | ≦5 | ≦3 | ≦1 |
| 4 | 60 | 36/4 | ≦10 | ≦5 | ≦3 | ≦1 |
| 5 | 50 | 45/5 | ≦10 | ≦5 | ≦3 | ≦1 |
| 6 | 40 | 54/6 | ≦10 | ≦5 | ≦3 | ≦1 |
| 7 | 30 | 63/7 | ≦10 | ≦5 | ≦3 | ≦1 |
| 8 | 20 | 72/8 | ≦10 | ≦5 | ≦3 | ≦1 |
| 9 | 10 | 81/9 | ≦10 | ≦5 | ≦3 | ≦1 |

Table II illustrates various component percentages by weight and varied IV values. For example, columns 2 and 3 provide approximate paraffin and TG/FFA percentages, respectively. Column 4 indicates an IV of 10 or less for the fatty material. Columns 5–7 indicate the same paraffin, TG and FFA percentages with IVs of 5 or less, 3 or less and 1 or less, respectively.

Based on the results of burning candles comprised substantially of low IV TG material (discussed in more detail in the above reference U.S. Patent Application entitled Low-Soot, Low-Smoke Renewable Resource Candle), it was anticipated that candles with high concentrations of low IV TGs would be low sooting. For the candle arrangements discussed in Table II, candles with high concentrations (50% or more) of low IV TGs were non-sooting or extremely low sooting. As the paraffin percentage increased, sooting tended to increase but these candles also demonstrated desirable low sooting or non-sooting properties. It should be recognized that lesser quality paraffins (defined as paraffins that are less refined and/or having higher oil content) used in these combinations also gave substantially reduced or non-sooting burn profiles suggesting that the effect of the low IV fatty substrates might be catalytic in nature.

While the candles of Table II have a 9:1 ratio of TG to FFA, it should be recognized that the percentage of FFA in the fatty material may range from 0% to more than 50% without deviating from the present invention.

It is suspected or hypothesized that the low soot or non-soot properties of these candles is a result of the low IV fatty material catalyzing a more complete combustion of the paraffin. Testing of various fuels over the past twenty years or more have shown that the propensity of an organic fuel to soot is decreased when the material is highly oxygenated (ethanol<ethane) and when the material is highly saturated (ethane<ethylene<ethyne (acetylene)). Since the fatty substrates referred to here are already fully oxygenated, the remaining variable is the degree of unsaturation. The low IVs of the TG and FFA material suggest that the non-sooting properties of the resultant candles are due in part to the high level of saturation of the low IV material. The low IVs, however, do not necessarily explain the significant reduction or elimination of soot from the paraffin component. This again suggests that the low IV fatty material may possibly "catalyze" oxidation of the paraffin, bringing about a more complete combustion.

Table III illustrates other experiments and embodiments of paraffin/FFA candles in accordance with the present invention. Table III illustrates varied paraffin and FFA combinations and varied IVs for these combinations.

TABLE III

Paraffin/FFA Candles with Varied IVs

| No. | Paraffin | FFA | TR1 | TR2 | TR3 | TR4 |
|---|---|---|---|---|---|---|
| 1 | 90 | 10 | ≦1 | ≦0.8 | ≦0.5 | ≦0.3 |
| 2 | 85 | 15 | ≦1 | ≦0.8 | ≦0.5 | ≦0.3 |
| 3 | 80 | 20 | ≦2 | ≦1 | ≦0.5 | ≦0.3 |
| 4 | 70 | 30 | ≦3 | ≦2 | ≦1 | ≦0.5 |
| 5 | 60 | 40 | ≦3 | ≦2 | ≦1 | ≦0.5 |
| 6 | 50 | 50 | ≦3 | ≦2 | ≦1 | ≦0.5 |
| 7 | 40 | 60 | ≦3 | ≦2 | ≦1 | ≦0.5 |
| 8 | 30 | 70 | ≦3 | ≦2 | ≦1 | ≦0.5 |

Measured results for these candles indicated the following. Using, for example, 30–60% FFA with an IV of 2 produced candles with substantially no detectable soot. This suggests that additional FFA (compared to the typical 5–15% FFA in conventional candles) is adequate to substantially reduce soot. Reducing the IV further reduced the soot. In candles having approximately >15% to 20% FFA, it was preferred to reduce the IV to near 1 or less to achieve desired non-sooting characteristics, though IVs of 2, etc., for this FFA percentage are within the present invention. In candles with approximately 20% or more by weight FFA, IVs of 2 and less achieved desired non-sooting characteristics. IVs of 3 and less also exhibited non-sooting properties, particularly as the percentage of FFA increased.

The above experiments illustrate that combining appropriately hydrogenated (i.e., low IV) triglycerides and/or free fatty acids with paraffin (in appropriate quantities) produces a substantially soot free candle.

The TGs used herein may be from any source such as animal (e.g., tallow), petrochemical or vegetable or a combination thereof, but are preferably vegetable-sourced because those sources are renewable and tend to have lesser or no malodors. These criteria also apply to the FFAs discussed herein. Suitable TGs and FFAs are elaborated on in more detail below.

Triglyceride (TG) and Free Fatty Acid (FFA) Components

Palm stearine (a hydrogenated TG) is preferred as the TG component because palm stearine is currently a low-cost by-product of palm oil processing and, therefore, readily available and relatively inexpensive. Furthermore, palm stearine and related plant source TGs are derived from a renewable, non-animal source and have lower odors.

The preferred FFA is vegetable sourced stearic acid for similar reasons.

While palm stearine and vegetable stearic acid are more preferred, it should be recognized that TGs and FFAs from other sources are suitable and included within the present invention. A partial list of raw material sources for these other TG and FFA raw materials is provided below. These TGs include those that have melting points between approximately 110 and 170 degrees F. (and it should be recognized that commercial TGs may have small quantities of diglyceride and monoglyceride components). These TGs preferably have highly saturated C16 and/or C18 fatty acid molecules (or predominantly have these molecules) which give the desired melt point.

Utilizing known separation and hydrogenation techniques (discussed below) any fat, oil or wax that contains relatively high quantities (approximately 50% or greater in total) of C12, C14, C16 and/or C18 fatty acids in the triglyceride molecule is a suitable and preferred source candidate for the triglyceride(s) and/or free fatty acid(s) of the present invention. Thus, in addition to palm oil, the TGs and/or FFAs of the present invention may be derived from the oils of rapeseed, canola, soybean, corn, cottonseed, olive, peanut, perilla, linseed, candlenut, rubberseed, safflower, poppy, walnut, tobacco, niger, sunflower, sesame, meadowfoam, kukui nut, macadamia nut, coconut and/or cocoa, amongst other seeds and/or nuts. It also should be recognized that the TG and FFA may be obtained from animal (e.g., tallow), petroleum or other non-plant sources, in addition to other plant sources.

Triglycerides that contain higher fatty acid homologues, such as C20, C22 and C24, etc., could be used and would tend to give higher melting points. Conversely, triglycerides that contain lower fatty acid homologues, such as C12 and C14, etc., could be used and would tend to give lower melting points Candle Formation Palm stearine is available commercially and is usually shipped as flakes. This flaked material can be provided in a form that already possesses the lower and more desired IVs of the present invention. The FFA vegetable stearic acid is similarly commercially available, shipped as flakes and provided having the lower and more desired IVs of the present invention. Paraffin may be provided in various chemical configurations and comes as flaked material, as slabs or blocks, or in molten form depending on handling capabilities.

The paraffin, TG and/or FFA materials are blended and melted together (preferably at temperatures of approximately 180° F.) to provide a homogeneous candle wax that is poured into a mold about wick 12. The molten wax cools to form the candle body 11.

Hydrogenation and IV

The TGs used in the present invention are preferably derived from one or more of the natural sources previously listed. The oils that are isolated from these natural sources are typically in liquid or semi-solid form and must be hydrogenated to yield the desired solid, waxy material from which a candle can be made. In the case of palm stearine, the starting material is palm oil or palm kernel oil and the "solid" portion which becomes palm stearine is isolated by chemical physical means to separate it from the more valuable palm oil. This crude solid palm stearine is then refined, bleached, and deodorized (RBD) to yield a RBD palm stearine that is semi-solid to solid at ambient temperature. This material is then hydrogenated to "harden" it. The hydrogenation is carried out with a suitable hydrogenation catalyst under hydrogen pressure and at elevated temperature. The hydrogenation is carried out until the RBD palm stearine is hardened and continues until the triglyceride material has a desired IV. It should be recognized that while the present discussion is directed to the palm stearine fraction, the palm oil fraction could alternatively be utilized (in whole or in part) and this may be desirable in some applications. In general, however, better economics are expected to be obtained with the palm stearine fraction due to lesser hydrogenation requirements and lower "opportunity costs" for this raw material.

A triglyceride composition that is low in fatty unsaturation has a lower propensity to soot as a fuel. Propensity to soot is a function of many variables, two of which are: 1) the degree of "unsaturation" (abundance of carbon-carbon double bonds) and 2) the scarcity of oxygen in the chemical structure of the substrate being burned. The higher the level of unsaturation (in the chemical structure) the greater the propensity to soot (conversely, the higher the level of saturation the lower the propensity to soot); the lower the level of oxygen (in the chemical structure) the greater the propensity to soot (conversely, the higher the level of oxygen the lower the propensity to soot). Since the triglyceride contains a high level of oxygen in the chemical structure (the tri-esters of glycerine and three fatty acids) the level of unsaturation becomes a key variable in determining propensity to soot.

While embodiments of candles having IVs of 1 or 0.5 or less are particularly preferred, candles having IVs of 14 or 12 or 10 or less are within the present invention. Lower IVs are typically achieved with increased substrate processing time and costs (i.e., more comprehensive hydrogenation processing). Thus, a candle with IV of 14–10 may have a cost that is less than that of a candle having an IV of 7.5 or 5 or less. With improvements in hydrogenation processing, however, saturation levels have increased while the cost of hydrogenation processing has decreased. This permits the attainment of TG and/or FFA materials having IVs of 3, 1, 0.5 or less that are economically priced. For persons who are most sensitive to combustion products or have other respiratory or soot/smoke sensitive conditions, a candle having a collective IV of 0.5 to 1 and perhaps up to 3 for the fatty materials will be preferred. Persons seeking a clean burning candle, yet who are less sensitive to soot may prefer or find adequate a candle with an IV from approximately 3 to 7.5. Other persons who want a clean candle, yet are very cost sensitive may prefer a candle as described herein with IVs from approximately 10 to 14. Note that these criteria include generalizations, and material costs may vary based on supply and demand, amongst other parameters.

While specific IV values are provided here, it should be recognized that the present invention's contribution of more fully hydrogenated plant source TGs and low soot, low smoke paraffin containing candles should not be limited by a specific number. The present invention is intended to cover candles of all IV below those taught by the prior art, particularly for candles containing plant source TGs and/or FFAs.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. A candle comprised of greater than 60% by weight of paraffin in combination with fatty material including hydrogenated triglycerides, wherein said fatty material has an Iodine Value of approximately 12.5 or less and is present in an amount sufficient to substantially prevent the formation of soot when the candle is burned.

2. The candle of claim 1, wherein said fatty material comprises at least approximately 15% by weight of said candle.

3. The candle of claim 1, wherein said fatty material has an Iodine Value of approximately 10 or less.

4. The candle of claim 1, wherein said fatty material has an Iodine Value of approximately 5 or less.

5. The candle of claim 1, wherein said fatty material has an Iodine Value of approximately 3 or less.

6. The candle of claim 2, wherein said fatty material has an Iodine Value of approximately 1 or less.

7. The candle of claim 1, wherein said fatty material further comprises free fatty acids.

8. The candle of claim 7, wherein said free fatty acids are at least in part plant source free fatty acids.

9. The candle of claim 1, including at least approximately 70% by weight paraffin.

10. The candle of claim 1, wherein said triglycerides are at least in part plant sources triglycerides.

11. A candle comprised of greater than 60% by weight of paraffin in combination with a fatty material including triglycerides and free fatty acids, said fatty material having an Iodine Value of approximately 12.5 or less and present in an amount sufficient to substantially prevent the formation of soot when said candle is burned.

12. The candle of claim 11, wherein the fatty material has an Iodine Value of approximately 8 or less.

13. The candle of claim 11, wherein the fatty material has an Iodine Value of approximately 3 or less.

14. The candle of claim 12, including at least approximately 70% by weight paraffin.

15. The candle of claim 11, wherein said triglycerides and said free fatty acid are at least in part plant sourced.

16. A candle comprised of greater than 60% by weight paraffin and including triglyceride material having an Iodine Value of less than 12.5 and present in an amount sufficient to substantially eliminate the formation of soot when the candle is burned.

17. A candle comprised of greater than 60% by weight paraffin in combination with free fatty acids, said free fatty acids having an Iodine Value not exceeding about 2 and present in an amount sufficient to substantially eliminate the formation of soot when the candle is burned.

18. The candle of claim 17, wherein said free fatty acids have an iodine value of approximately 1 or less.

19. The candle of claim 17, wherein said free fatty acids have an iodine value of approximately 0.8 or less.

20. The candle of claim 17, wherein said free fatty acids have an iodine value of approximately 0.5 or less.

21. The candle of claim 17, wherein said free fatty acids have an iodine value of approximately 0.3 or less.

22. The candle of claim 21, wherein said candle is comprised of at least about 15% by weight of said free fatty acids.

23. The candle of claim 17, wherein said candle is comprised of at least about 30% by weight of said free fatty acids.

24. The candle of claim 17, additionally including one or more other components selected from the group consisting of: triglycerides having an IV of 2 or less, scents, colors, and wicks.

* * * * *